United States Patent [19]

Muramatsu

[11] Patent Number: 4,963,113

[45] Date of Patent: Oct. 16, 1990

[54] METHOD FOR PRODUCING PHOTOMULTIPLIER TUBE

[75] Inventor: Shinichi Muramatsu, Shizuoka, Japan

[73] Assignee: Hamamatsu Photonics K.K., Shizuoka, Japan

[21] Appl. No.: 388,034

[22] Filed: Aug. 1, 1989

[30] Foreign Application Priority Data

Aug. 1, 1988 [JP] Japan ..... 63-195195

[51] Int. Cl.[5] ..... H01J 9/12

[52] U.S. Cl. ..... 445/58

[58] Field of Search ..... 445/14, 19, 20

[56] References Cited

U.S. PATENT DOCUMENTS 2,773,730 12/1956 Lewin ..... 445/14

*Primary Examiner*—Kenneth J. Ramsey

*Attorney, Agent, or Firm*—Finnegan, Henderson, Farabow, Garrett, and Dunner

[57] ABSTRACT

In a method of producing a photomultiplier tube comprising a vacuum container having an incident window, a photocathode formed on the inner surface of the incident window and an electron multiplier element spaced from the photocathode, a depositing mesh electrode on which a constituent for forming the photocathode has been deposited in advance is arranged between the photocathode and the electron multiplier element, and the constituent deposited on the depositing mesh electrode is deposited on the inner surface of said incident window, to form the photocathode.

12 Claims, 3 Drawing Sheets

METHOD FOR PRODUCING PHOTOMULTIPLIER TUBE

BACKGROUND OF THE INVENTION

This invention relates to a method of producing a photomultiplier tube including a vacuum container having an incident window, a photocathode formed on the inner surface of the incident window and an electron multiplier element spaced from the photocathode, and more particularly to a method of producing a photomultiplier tube in which the photocathode having high sensitivity and high uniformity can be easily formed.

In general, in order to form a photocathode excellent in characteristic and in uniformity a depositing source for depositing constituents for forming the photocathode should be spaced from the inner surface of the incident window, and the distance there between should be at least about the diameter of the photocathode. Further, depending on its use, the distance between the photocathode and the electron multiplier element must be decreased.

For instance, the paper entitled "Position Sensitive Photomultiplier Tube for Scientillation Imaging" by Eiji Kume, Shinichi Muramatsu and Masahiro Iida presented at NSS in Nov. 1985 has disclosed a position sensitive photomultiplier tube in which the position of a light beam applied to the photocathode can be obtained.

In such a position sensitive photomultiplier tube, the position of a light beam applied to the photocathode cannot be obtained unless the photocathode is disposed close to the electron multiplier element. Accordingly, unlike a conventional photomultiplier tube, it is impossible to provide the depositing source inside the tube, and therefore the constituents are deposited before the tube is sealed.

However, this method is disadvantageous in that, due to oxygen in the air and heating during the tube sealing operation, the sensitivity of the photocathode is lower than that of the ordinary photomultiplier tube.

On the other hand, in the case of a proximity-type image intensifier, the photocathode is formed in the same vacuum device, and is then combined with the body of the photomultiplier tube provided at a different position, and then the tube is sealed. In this case, the photocathode can be disposed close to the electron multiplier element, and the sensitivity of the photocathode can be made substantially equal to that of the ordinary photomultiplier tube.

However, this method is also disadvantageous in that a manufacturing machine for producing a photomultiplier tube is difficult to handle, and is not suitable for mass production, so that the manufacturing cost is high.

SUMMARY OF THE INVENTION

An object of this invention is to eliminate the above-described difficulties accompanying a conventional photomultiplier tube producing method. More specifically, an object of the invention is to provide a photomultiplier tube producing method in which a photocathode high both in sensitivity and in uniformity can be easily formed.

The foregoing object of the invention is achieved by the provision of a method of producing a photomultiplier tube comprising: a vacuum container having an incident window; a photocathode formed on the inner surface of the incident window; and an electron multiplier element spaced from the photocathode in which a depositing mesh electrode provided beforehand with constituents for forming the photocathode is arranged between the inner surface of the incident window and the electron multiplier element, and the constituents provided on the depositing mesh electrode is deposited on the inner surface of the incident window, to thereby form the photocathode in the vacuum container.

In the method, the mesh pitch of the depositing mesh electrode is preferably designed to be equal to or less than two times the distance between the inner surface of the incident window and the mesh electrode.

In the method, the constituents are deposited on the inner surface of the incident window preferably by application of current to the depositing mesh electrode.

In the photomultiplier tube thus constructed, the depositing mesh electrode on which a constituent such as Sb (antimony) for forming the photocathode has been suitably deposited in advance is arranged between the inner surface of the incident window and the electron multiplier element. Therefore, similarly as in the manufacture of the ordinary photomultiplier tube, a vacuum container such as a tube is subjected to vacuum-degassing, and then the constituent is deposited uniformly on the inner surface of the incident window by application of current to the depositing mesh electrode. Thereafter, the layer of constituent is activated with alkaline metal to complete the formation of a photocathode. Thus, the photocathode high in sensitivity and in uniformity can be easily formed.

In the case where the mesh pitch of the depositing mesh electrode is not more than two times the distance between the mesh electrode and the inner surface of the incident window, the constituent for forming the photocathode can be more accurately and uniformly deposited on the inner surface of the incident window Furthermore, in the case where the constituent is deposited on the inner surface of the incident window by applying current to the depositing mesh electrode, the vacuum deposition can be achieved considerably easily.

DETAILED DESCRIPTION OF THE INVENTION

A preferred embodiment of this invention which is applied to a proximity-type photomultiplier tube of position sensitive detection type will be described in detail with reference to the accompanying drawings.

Figure 1:
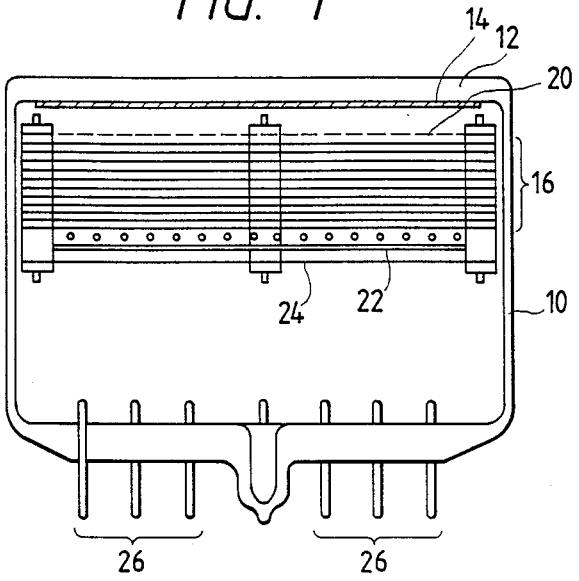
FIG. 1 is a sectional view showing the arrangement of one example of a proximity-type photomultiplier tube which is produced by the method according to this invention.

A photomultiplier tube produced according to the invention, as shown in FIG. 1, comprises: a vacuum container, namely, a tube 10 having an incident window 12; a photocathode 14 formed on the inner surface of the incident window 12; and an electron multiplier element 16 spaced slightly from the photocathode 14. The photomultiplier tube further comprises: a depositing mesh electrode 20 located between the photocathode 14 (inner surface of the incident window 12) and the electron multiplier element 16, on which a constituent such as Sb (antimony) for forming the photocathode 14 has been provided (for example, deposited) in advance.

Figure 2:
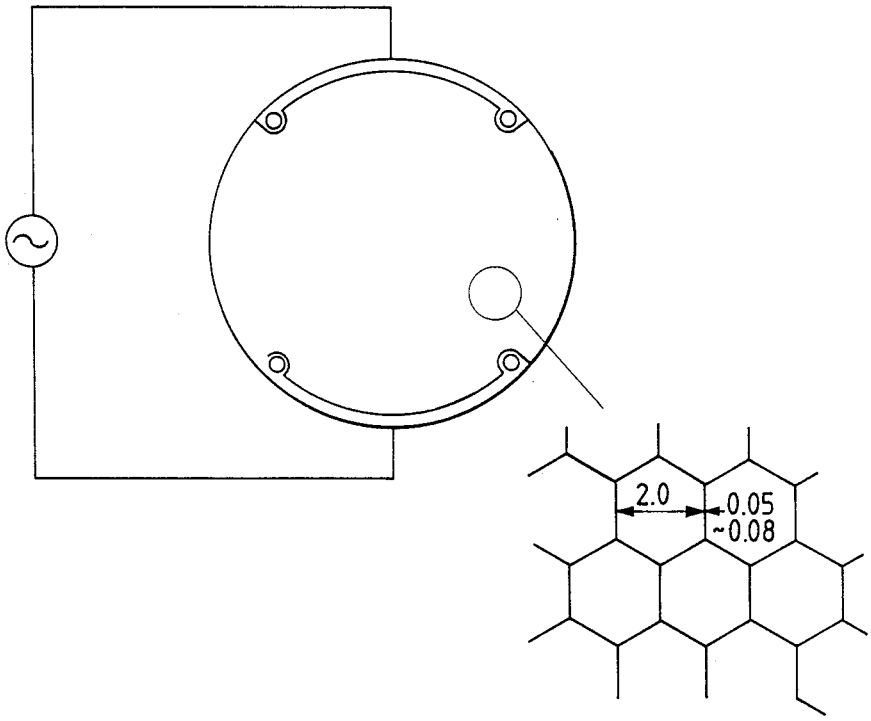
FIG. 2 is a plan view for showing the configuration of one example of a depositing mesh electrode used in the proximity-type photomultiplier tube and for explaining a method of applying current thereto.
Figure 3:
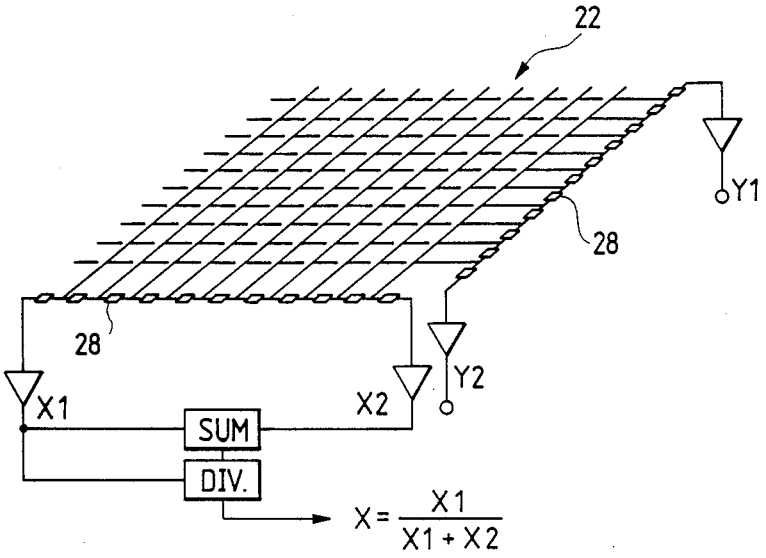
FIG. 3 is a perspective view for showing the configuration and action of crossed wire anodes in the photo multiplier tube.

Further, reference numeral 22 designated a crossed wire anode as shown in FIG. 3; 24, the last dynode of reflection type, for instance; and 26, output terminals. The electron multiplier element 16 is made up of, for instance, 11 staged mesh dynodes. The depositing mesh electrode is made of stainless steel in such a manner that, as shown in FIG. 2, it has a number of regular hexagonal openings arranged at a mesh pitch of 2 mm, and the wires surrounding the openings are 0.05 to 0.08 mm in width.

The proximity-type tube thus organized is produced as follows:

A suitable amount of constituent such as antimony (Sb) for forming the photocathode 14 is beforehand deposited on the depositing mesh electrode 20 of stainless steel as shown in FIG. 2. Similarly in the manufacture of the ordinary photomultiplier tube, the tube 10 is subjected to vacuum-degassing, and then current of several amperes is applied to the depositing mesh electrode 20 so that Sb for forming the photocathode 14 is uniformly deposited on the inner surface of the incident window 12. Thereafter, the layer of Sb is activated using alkaline metal, to thereby form the photocathode 14. The other manufacturing steps are the same as those in the prior art.

When photons are applied to the incident window 12 of the proximity-type photomultiplier tube, electrons are emitted from the photocathode 14. The electrons thus emitted collide with the first (or the uppermost) mesh dynode to emit secondary electrons. This operation is carried out with the remaining mesh dynodes in the same manner, so that the number of electrons is greatly increased. Thus, the secondary electron flux emitted from the last dynode 24 which is, for instance, of reflection type, is collected by the crossed wire anodes 22. Accordingly, the crossed wire anodes 22 can measure the positions of electrodes in a plane which is in parallel with the photocathode 14. That is, the electrons collected by the anodes are divided by resistor chains 28 as shown in FIG. 3, and the electron distribution center on the last dynode 24 is calculated as indicated in FIG. 3. By obtaining the electron distribution centers of the crossed wire anode, the position of the incident light (photons) to the photocathode 14 can be detected.

Figure 4:
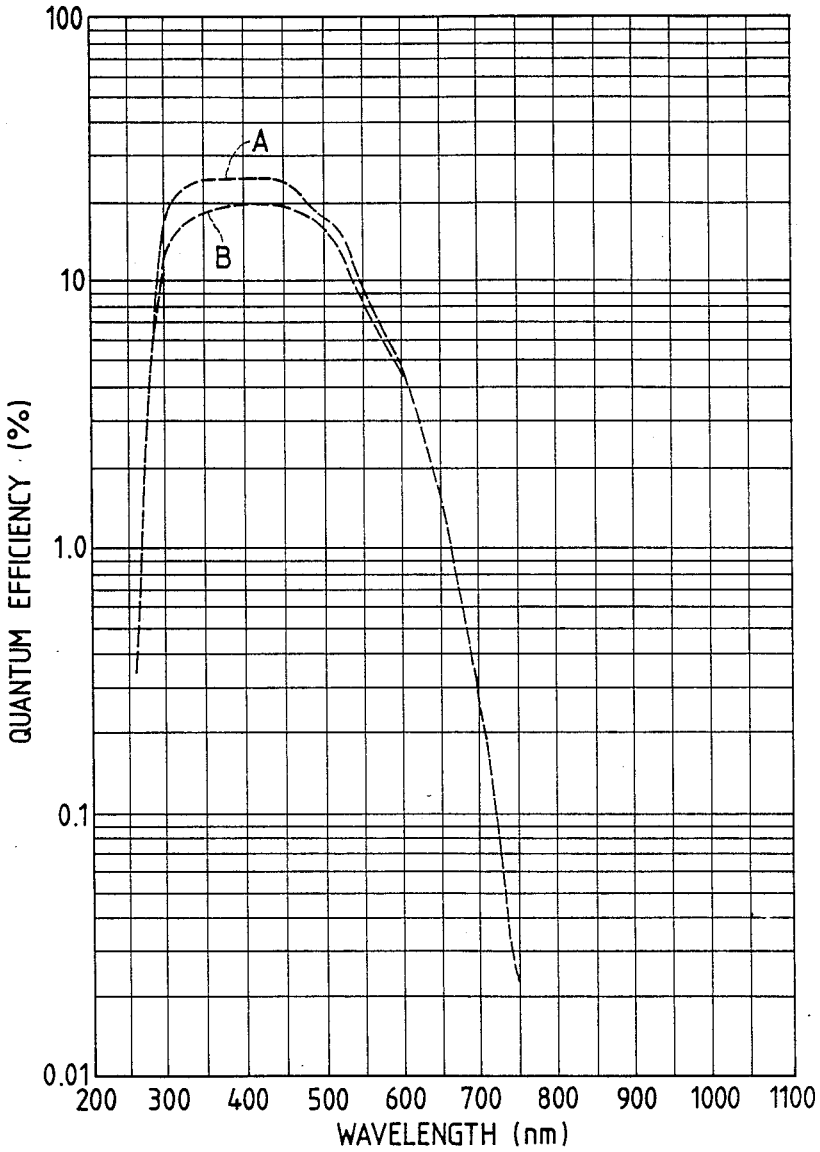
FIG. 4 is a graphical representation indicating the spectral response (sensitivity) of the photomultiplier tube which is produced by the method according to the invention and a conventional one in comparison.

When the quantum efficiency of the bi-alkaline photocathode manufactured according to the method of the invention was measured, and its spectral response (sensitivity) was as indicated by the broken line A in FIG. 4. In comparison with the spectral response (sensitivity) of a conventional position sensitive photomultiplier tube, it has been confirmed that the quantum efficiency of the method of this invention is improved as much as 25%.

Figure 5:
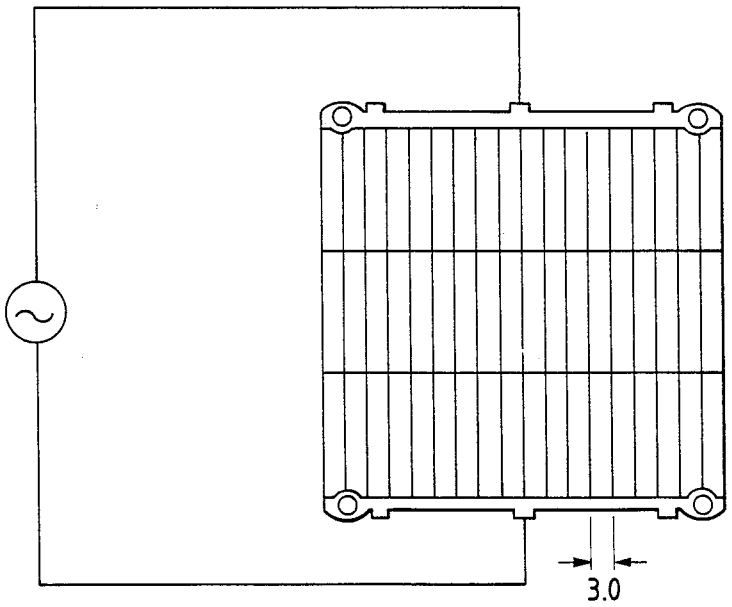
FIG. 5 is a plan view for showing the configuration of another example of the depositing mesh electrode and a method of applying current thereto.

In the embodiment, the openings of the depositing mesh electrode 20 are designed in a regular hexagonal form so that the photocathode 14 is improved in uniformity. However, the configuration of the mesh electrode is not always limited to that described above. For instance, a mesh electrode having rectangular openings arranged at a mesh pitch of 3.0 mm as shown in FIG. 5 may be employed. That is, a mesh electrode can be put in practical use so far as the mesh electrode has a certain degree of openings. The mesh electrode having rectangular openings as shown in FIG. 5 is advantageous in that it can be easily formed.

In the above-described embodiment, the depositing mesh electrode 20 is made of stainless steel low in specific resistance; however, the material of the mesh electrode is not limited thereto. The same effect can be obtained by using the mesh electrode made of a material relatively high in specific resistance such as tungsten, Nichrome, molybdenum or the like.

In the above-described embodiment, the constituent for forming the photocathode which has been beforehand-deposited on the mesh electrode 20 is deposited by application of current thereto. However, the method of depositing the constituent is not always limited to that which has been described. For example, the same effect can be obtained by using a method in which high frequency heating is employed.

Furthermore, in the above-described embodiment, the constituent for forming the photocathode is Sb; however, it should be noted that the invention is not limited thereto or thereby; that is, a constituent such as tellurium may be used for formation of the photocathode with a deposition technique.

In the above-described embodiment, the technical concept of the invention is applied to the proximity-type photomultiplier tube of position sensitive detection type in which the photocathode and the electron multiplier element are set close to each other. However, the invention is not limited thereto or thereby. That is, the technical concept of the invention is equally applicable to other proximity-type photomultiplier tubes and general photomultiplier tubes.

Further, when a mesh electrode, for example, for the purpose of accelerating photoelectrons emitted from the photocathode 14, is provided between the photocathode 14 and the electron multiplier element 16, the mesh electrode may be used as both a depositing mesh electrode and an accelerating electrode by depositing the constituent such as antimony (Sb) or the like on the mesh electrode in advance. When a mesh electrode is provided for a different purpose from the above purpose, the mesh electrode can be used both as a member for perfoming the different purpose and a depositing mesh electrode.

What is claimed is:

1. A method of producing a photomultiplier tube including a vacuum container having an incident window, a photocathode formed on the inner surface of the incident window and an electron multiplier element spaced from the photocathode, comprising the steps of:

providing a mesh electrode with a constituent for forming the photocathode in advance;

arranging the mesh electrode provided with the constituent between the inner surface of the incident window and the electron multiplier element; and depositing the constituent of the mesh electrode on the inner surface of the incident window.

2. A method as claimed in claim 1, wherein the mesh electrode is arranged between the inner surface of the incident window and the electron multiplier element so that the pitch of the mesh electrode is not more than two times the distance between the inner surface of the incident window and the mesh electrode.

3. A method as claimed in claim 1, wherein said depositing step comprises the step of applying current to the mesh electrode provided with the constituent.

4. A method as claimed in claim 1, wherein said providing step comprises the step of depositing the constituent on the mesh electrode.

5. A method as claimed in claim 1, wherein the constituent for forming the photocathode is any one of Antimony and Tellurium.

6. A method as claimed in claim 1, wherein the mesh electrode comprises a plurality of regular hexagonal openings and wires surrounding the openings.

7. A method as claimed in claim 6, wherein the openings are arranged at a mesh pitch of 2 mm and each of the wires has a width of 0.05 to 0.08 mm.

8. A method as claimed in claim 1, wherein the mesh electrode comprises a plurality of rectangular openings and wires surrounding the openings.

9. A method as claimed in claim 8, wherein the openings are arranged at a mesh pitch of 3.0 mm.

10. A method as claimed in claim 1, wherein the mesh electrode comprises any one of stainless steel, tungsten, Nichrome and molybdenum.

11. A method as claimed in claim 1, further comprising the step of activating the constituent deposited on the inner surface of the incident window with alkaline metal.

12. A method as claimed in claim 1, wherein the mesh electrode is used as an accelerating electrode for accelerating photoelectrons emitted from the photocathode.

* * * * *

UNITED STATES PATENT AND TRADEMARK OFFICE

CERTIFICATE OF CORRECTION

PATENT NO. : 4,963,113

DATED : October 16, 1990

INVENTOR(S) : Shinichi Muramatsu

It is certified that error appears in the above-identified patent and that said Letters Patent is hereby corrected as shown below:

On the title page:

In the Foreign Application Priority Data, please delete Priority Date "August 1, 1988" and insert the --August 4, 1988--.

Signed and Sealed this

Seventh Day of July, 1992

*Attest:*

DOUGLAS B. COMER

*Attesting Officer*

*Acting Commissioner of Patents and Trademarks*